United States Patent [19]

Marsh

[11] 4,430,820

[45] Feb. 14, 1984

[54] EJECTED CARTRIDGE CASE RECEIVER

[76] Inventor: Cecil D. Marsh, 913 N. Benson Ave., Upland, Calif. 91786

[21] Appl. No.: 338,029

[22] Filed: Jan. 8, 1982

[51] Int. Cl.[3] ..... F41C 27/00

[52] U.S. Cl. ..... 42/1 T

[58] Field of Search ..... 42/1 T; 89/33 F

[56] References Cited

U.S. PATENT DOCUMENTS

| | | | |
|---|---|---|---|
| 2,354,277 | 7/1944 | Richardson | 42/1 T |
| 3,739,685 | 6/1973 | Lundgren | 42/1 T |
| 4,028,834 | 6/1977 | Dobson | 42/1 T |
| 4,204,353 | 5/1980 | Isola | 42/1 T |
| 4,334,375 | 6/1982 | Olson | 42/1 T |

*Primary Examiner*—Charles T. Jordan

*Attorney, Agent, or Firm*—Boniard I. Brown

[57] ABSTRACT

Apparatus for collecting cartridge cases ejected from an associated firearm, having an action and an elongated barrel having a geometric axis. A container has at least first and second elongated flanges disposed in mutually perpendicular relationship with the first flange disposed in substantially perpendicular relationship to the geometric axis of the barrel. A deflection surface is provided for deflecting ejected cartridge cases. The deflection surface has at least a part which is generally planar and which is disposed in oblique relationship to the first elongated flange. The apparatus includes a structure for removably securing the container to the associated firearm adjacent to the action.

18 Claims, 7 Drawing Figures

EJECTED CARTRIDGE CASE RECEIVER

BACKGROUND OF THE INVENTION

The invention relates to firearms and particularly to apparatus for receiving cartridge cases which are ejected by a firearm.

Various apparatus for receiving ejected cartridge cases are known. Known apparatus includes those described in the following U.S. Pat. Nos.: 2,354,277; 4,028,834; 4,166,333; 4,204,353.

Many rifles, including semi-automaic and automatic rifles, discharge empty or spent cartridge cases a considerable distance from the firearm from which they are fired. One such rifle is the model HK-91, manufactured by Heckler and Koch. The vigorous ejection of cartridge cases has the side effect that the cartridge cases are vulnerable to being damaged if an attempt is made to collect them in conventional apparatus. An additional effect is that if the cartridge cases are allowed to fly through the air without any attempt being made to collect them, they are easily lost. The difficulty of finding the ejected cartridge cases is typically aggravated by the speed with which they are ejected and the concentration of the user of the firearm on a target, thus making it difficult for the user to observe the location where they fall. Frequently the cartridge cases will be deposited where they may be hidden by grass, bushes and other objects which will further complicate the retrieval process. Because the cartridge cases may be reloaded and used many times, this is very expensive, particularly when the weapon is being used for target shooting or other uses where a large quantity of ammunition is being expended.

It is an object of the invention to provide apparatus which will receive and collect without damage cartridge cases which have been ejected by a firearm.

It is another object of the invention to provide apparatus which has a permanently attached receptacle for containing the cartridge cases and which thus will not be vulnerable to being inadvertently detached or lost.

It is another object of the invention to provide apparatus which is compatible with known telescopic sights and mounts for such telescopic sights.

Still another object of the invention is to provide apparatus which will not damage either the firearm itself or any of the associated telescopic sight or sight mounting apparatus.

Yet another object of the invention is to provide apparatus which is simple and inexpensive to manufacture.

SUMMARY OF THE INVENTION

The foregoing objects and other objects and advantages which shall become apparent from the detailed description of the preferred embodiment are attained in an apparatus for collecting cartridge cases ejected from an associated firearm, which has an action and an elongated barrel having a geometric axis. The apparatus includes a container which has at least first and second elongated flanges disposed in mutually perpendicular relationship with the first flange disposed in substantially perpendicular relationship to the geometric axis of the barrel and a deflection surface for deflecting ejected cartridge cases. The deflection surface has at leat a first part which is generally planar and which is disposed in oblique relationship to the first elongated flange. The apparatus also includes means for removably securing the container to the associated firearm adjacent to the action thereof.

In some forms of the apparatus the deflection surface is a lamination and the lamination may be a lamination of alternate layers of a rubber and a metal. The metal may be aluminum. The means for removably securing the container may comprise an elongated lip and an opposed locking screw which has an axis thereof disposed in generally coplanar relationship with the lip and an arch shaped member. The container may also include a bag depending from the first and second elongated flanges which extends intermediate at least a portion of the lamina of the lamination.

In some forms of the invention the deflection surface further comprises a second generally planar part which is disposed in generally oblique relationship to the first part. The first and second parts of the deflection surface extend respectively from the first and second elongated flanges and extend generally inwardly to a portion of the apparatus which is uppermost when installed on the associated firearm. The first and second parts of the deflection surface may intersect at a compound angle.

BRIEF DESCRIPTION OF THE ACCOMPANYING DRAWING

DESCRIPTION OF THE PREFERRED EMBODIMENT

Figure 1:
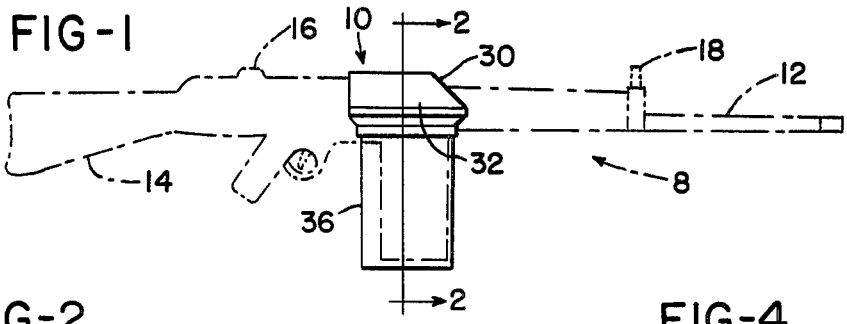
FIG. 1 is an elevational view of a rifle on which the apparatus in accordance with the invention is mounted.

Referring now to FIGS. 1-7, there is shown a rifle 8 which includes a barrel 12 having a geometric axis (not shown), a stock 14, a rear sight 16 and a front sight 18. The rifle 8 is also provided with an elongated telescopic sight mounting surface 20 which is shown in phantom outline in FIG. 2.

Figure 2:
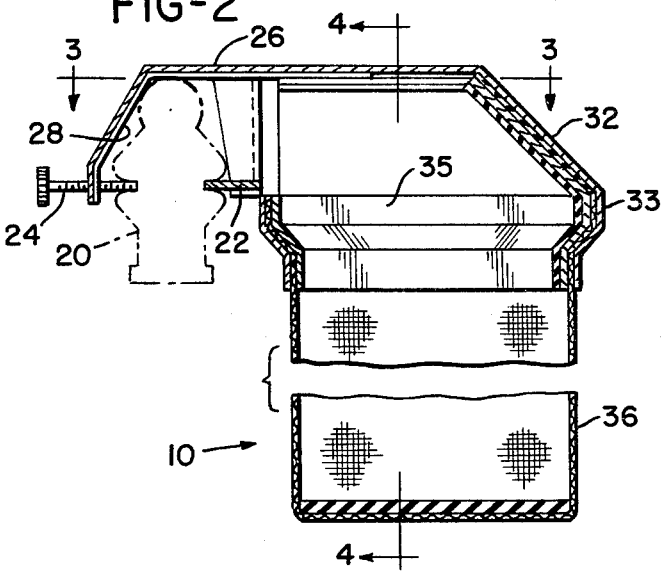
FIG. 2 is a sectional view taken along the line 2—2 of FIG. 1.
Figure 4:
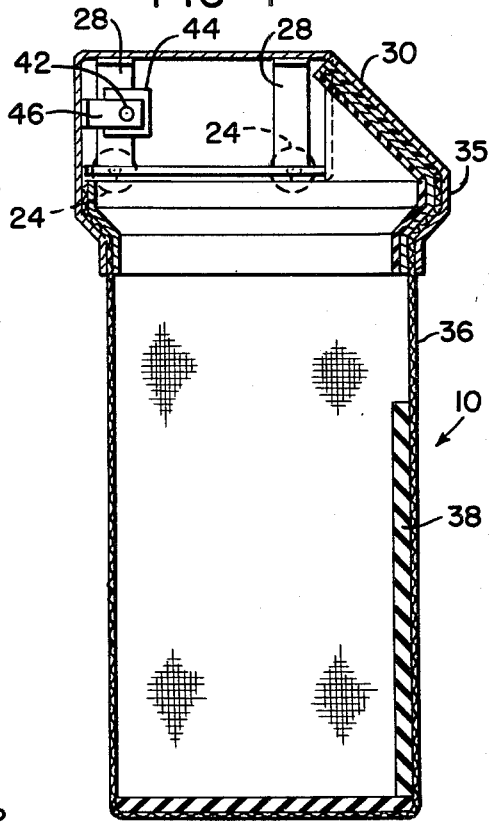
FIG. 4 is a sectional view taken along the line 4—4 of FIG. 2.

A container assembly 10 is mounted on the rifle 8. As best seen in FIG. 2, the container assembly 10 is mounted on the elongated telescopic sight mounting surface 20 by means of a lip 22 and an opposed screw 24. It will be seen, in FIG. 2, that the geometric axis of the screw 24 is coplanar with the lip 22. Ordinarily, the screw 24 may be manufactured of nylon so as to avoid marring the finish of the elongated telescopic sight mounting surface 20.

Figure 3:
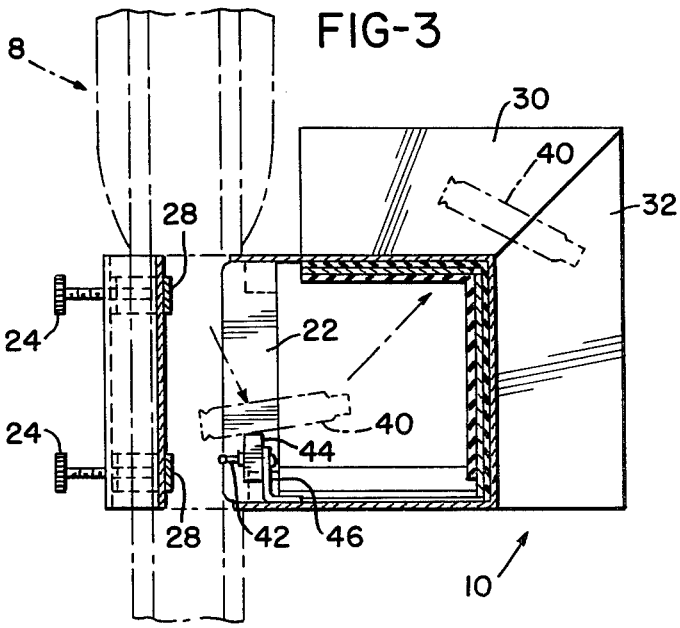
FIG. 3 is a sectional view taken along the line 3—3 of FIG. 2.
Figure 5:
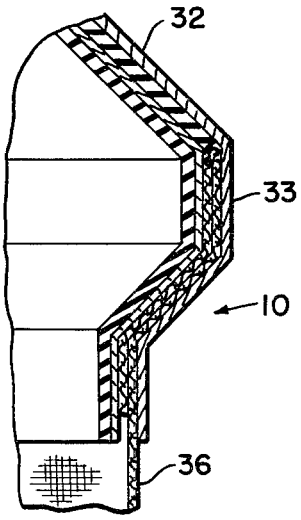
FIG. 5 is an enlarged fragmentary sectional view illustrating the manner of mounting of the bag portion of the apparatus in accordance with the invention.
Figure 6:
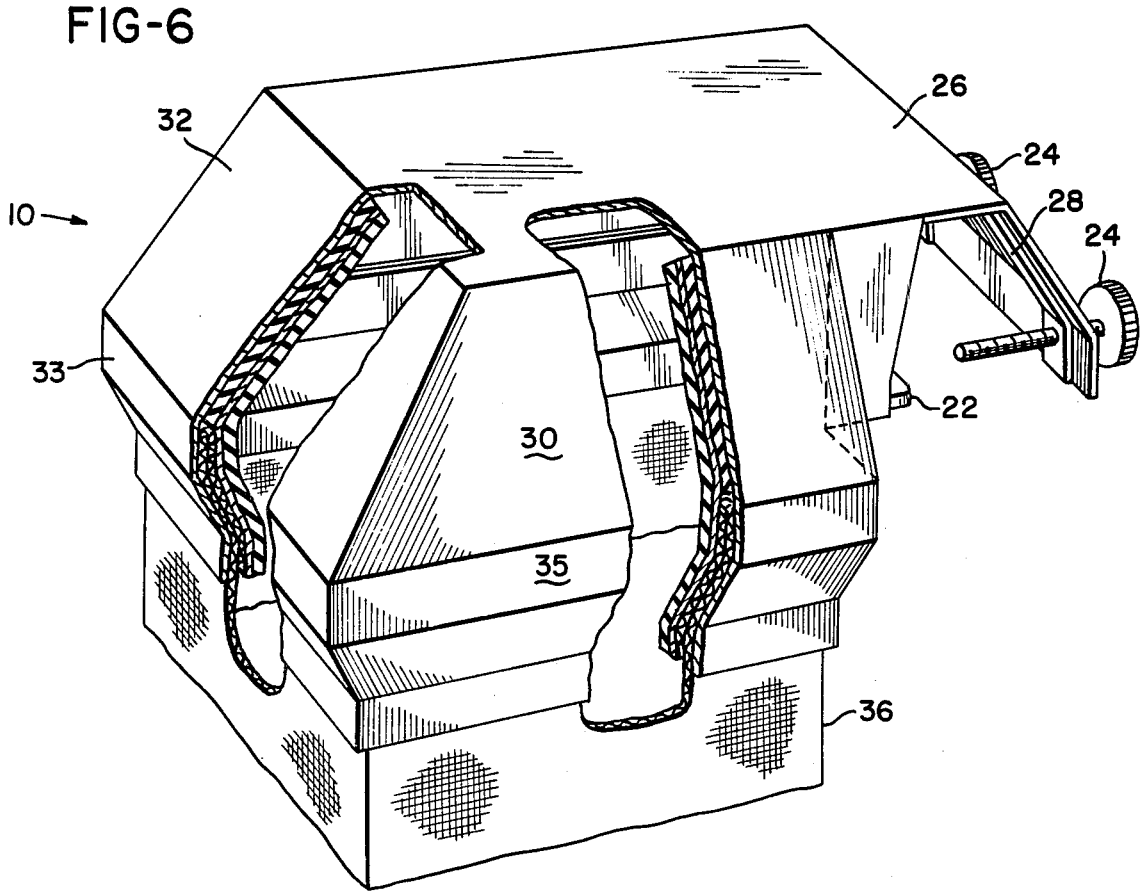
FIG. 6 is a cut away perspective view of the apparatus in accordance with one form of the invention.
Figure 7:
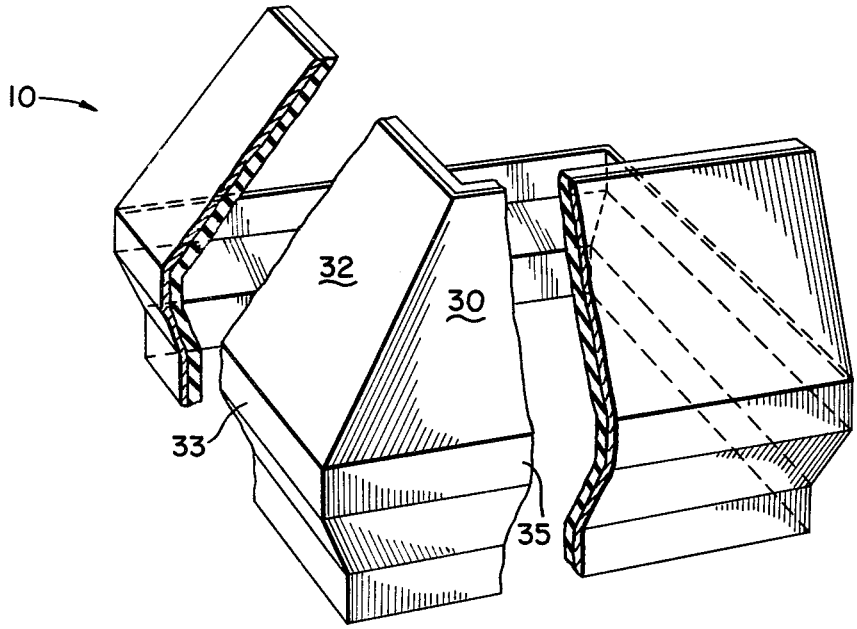
FIG. 7 is a cut away perspective view of a portion of the apparatus illustrated in FIG. 6.

The container assembly 10 includes an arch shaped member 26 which extends over the top of the rifle 8 and more particularly over the top of the elongated telescopic sight mounting surface 20. The arch shaped member 26 is ordinarily manufactured of aluminum and in the region wherein screws 24, 24 (see FIG. 3) are installed a reinforcement strap 28 is provided to ensure that the structure of the container assembly 10 is sufficiently rigid. The container assembly 10 includes a deflection surface which comprises first and second generally planar surfaces 30, 32 which are respectively disposed in generally oblique relationship to mutually perpendicular planes (not shown) of which one is parallel to the geometric axis of the barrel 12. Disposed within the planes are the elongated flanges 33 and 35 which depend from the generally planar surfaces 30, 32. In some forms of the invention, the flanges 33, 35 may be step-shaped as shown in the drawing. The generally planar surfaces 30, 32 intersect at a compound angle (an oblique relationship when viewed in two different directions which are at right angles with respect to each other) and extend generally inwardly toward the top of the container assembly 10. The surfaces 30, 32 are laminated. As shown in the various views, the surfaces 30, 32 are alternately layers (starting from the inside) of rubber, aluminum, rubber and aluminum. As best seen in FIG. 7, the single lamina of rubber and another lamina of aluminum are fabricated as a sub-assembly. This sub-assembly is inserted into a second sub-assembly which is towards the outer lamina of aluminum and rubber. Intermediate the two sub-assemblies is positioned the peripheral extent of a flexible plastic bag 36, as best seen in FIGS. 2, 4, 5, and 6. In one form, as best seen in FIG. 5, one of the lamina or one of the sub-assemblies is folded over the peripheral edge of the bag 36. The bag 36 is provided, along at least a portion of the walls thereof, with a rubber insert 38 for further reducing the energy of the ejected cartridge cases. As best seen in FIG. 3, the cartridge cases 40 are ordinarily ejected obliquely away from the user and the rifle 8. Thus the cartridge cases 40 ordinarily impact on the deflection surface which comprises the two generally planar parts or surfaces 30, 32. Because of the laminated construction thereof, the cartridge cases 40 harmlessly fall into the bag 36. It has been found that the combination of the oblique orientation of the parts 30, 32 and the laminated construction of the deflection surface avoids any injury to the cartridge cases 40 and harmlessly directs them into the bag 36.

As best seen in FIG. 3, there is provided a construction for engagement near the action of the rifle 8 which includes a rivet 42 which secures a rectangular buffer block 44 on an L-shaped bracket 46 which is fixed to the container assembly 10. The buffer block 40 is disposed proximate to the area of exit of the cartridge case 40 from the action of the rifle 8. The buffer block is an important feature of the invention because it prevents denting of the cartridge case 40 as it is ejected. The block 44 eliminates a major source of damage to the cartridge cases 40.

The apparatus in accordance with the invention has been found to be highly advantageous in that it will function even with rifles and other arms having ejector mechanisms which throw the used cartridge case with considerable force. Also, advantageously, the bag 36 is securely held in place where it will not become inadvertently detached or lost. The cartridge case is slowed in its travel without any damage to it. In addition, the mounting of the apparatus has been found to be secure and to avoid any vibration or damage to the telescopic mount sights. The manner of engagement with the rifle has been found also to work well with large number of telescope sight mounts.

The invention has been described with reference to its illustrated preferred embodiment. Persons skilled in the art may, upon exposure to the teachings herein, conceive variations in the mechanical development of the components therein. Such variations are deemed to be encompassed by the disclosure, the invention being delimited only by the appended claims.

I claim:

1. Apparatus for collecting cartridge cases ejected from an associated firearm, including an action and an elongated barrel having a geometric axis, which comprises:

a container having at least first and second elongated flanges disposed in mutually perpendicular relationship with the first flange disposed in substantially perpendicular relationship to the geometric axis of the barrel, a deflection surface for deflecting ejected cartridge cases, said deflection surface having at least a first part which is generally planar and which is disposed in oblique relationship to said first elongated flange, said deflection surface being a lamination, and means for removably securing said container to the associated firearm adjacent to the action thereof.

2. The apparatus as described in claim 1, wherein:

said lamination is a lamination of alternate layers of a rubber and a metal.

3. The apparatus as described in claim 2, wherein:

said metal is aluminum.

4. The apparatus as described in claim 3, wherein:

said means for removably securing said container comprises an elongated lip and an opposed locking screw having an axis thereof disposed in generally coplanar relationship with said lip.

5. The apparatus as described in claim 4, wherein:

said means for removably securing said container comprises an arch shaped member.

6. The apparatus as described in claim 5, wherein:

said container includes a bag depending from said first and second elongated flanges.

7. The apparatus as described in claim 6, wherein:

said bag extends intermediate at least a portion of the lamina of said lamination.

8. The apparatus as described in claim 7, wherein:

said deflection surface further comprises a second part which is generally planar and which is disposed in generally oblique relationship to said first part, said first and second parts of said deflection surfaces extending respectively from said first and second elongated flanges and also extending generally inwardly to a portion of said apparatus which is uppermost when installed on the associated firearm.

9. The apparatus as described in claim 8, wherein:

said first and second parts of said deflection surface intersect at a compound angle.

10. The apparatus as described in claims 1, 2, 3, 4, 5, 6, 7, 8 or 9, further including:

a buffer block disposed proximate to the cartridge case area of exit from the action of the associated firearm.

11. Apparatus for collecting cartridge cases ejected from an associated firearm, including an action and an elongated barrel having a geometric axis, which comprises:

a container having at least first and second elongated flanges disposed in mutually perpendicular relationship with the first flange disposed in substantially perpendicular relationship to the geometric axis of the barrel;

a deflection surface for deflecting ejected cartridge cases, said deflection surface having at least a first part which is generally planar and which is disposed in oblique relationship to said first elongated flange, said deflection surface further comprising a second part which is generally planar and which is disposed in generally oblique relationship to said first part, said first and second parts of said deflection surfaces extending respectively from said first and second elongated flanges and also extending generally inwardly to a portion of said apparatus which is uppermost when installed on the firearm; and means for removably securing said container to the firearm adjacent to the action thereof.

12. The apparatus as described in claim 11, wherein: said means for removably securing said container comprises an elongated lip and an opposed locking screw having an axis thereof disposed in generally coplanar relationship with said lip.

13. The apparatus as described in claim 12, wherein: said means for removably securing said container comprises an arch shaped member.

14. The apparatus as described in claim 13, wherein: said container includes a bag depending from said first and second elongated flanges.

15. The apparatus as described in claim 11, wherein: said first and second parts of said deflection surface intersect at a compound angle.

16. The apparatus as described in claim 15, further including:

a buffer block disposed proximate to the cartridge case area of exit from the action of the firearm.

17. Apparatus for collecting cartridge cases ejected from an associated firearm, including an action and an elongated barrel having a geometric axis, which comprises;

a container having a deflection surface for deflecting ejected cartridge cases, said deflection surface having at least a first part which is generally planar and whch is disposed in oblique relationship to the elongated barrel, said deflection surface further comprising a second part which is generally planar and which is disposed in generally oblique relationship to said first part; and means for removably securing said container to the firearm adjacent to the action thereof with the intersection of said first and second parts in line with the path of ejected cartridge cases.

18. The apparatus as described in claim 17, wherein: said first and second parts of said deflection surface intersect at a compound angle.

* * * * *